United States Patent [19]

Frazzell et al.

[11] Patent Number: 4,636,175

[45] Date of Patent: Jan. 13, 1987

[54] WATER INLET FOR OUTBOARD PROPULSION UNIT

[75] Inventors: Michael E. Frazzell, Neenah; Michael A. Karls, Hilbert, both of Wis.

[73] Assignee: Brunswick Corporation, Skokie, Ill.

[21] Appl. No.: 796,051

[22] Filed: Nov. 7, 1985

[51] Int. Cl.[4] ..... B63H 21/10

[52] U.S. Cl. ..... 440/88; 416/91

[58] Field of Search ..... 440/88, 89, 66, 76–78; 416/91, DIG. 4; 406/117

[56] References Cited

U.S. PATENT DOCUMENTS

| | | | |
|---|---|---|---|
| 1,762,957 | 6/1930 | Buehner | 440/88 |
| 2,021,309 | 11/1935 | Irgens | 440/78 |
| 2,333,555 | 1/1943 | Prucha | 416/91 |
| 2,536,005 | 12/1950 | Knuth | 440/76 |
| 2,616,386 | 11/1952 | Kiekhaefer | 115/17 |
| 2,847,967 | 8/1958 | Kiekhaefer | 115/18 |
| 3,164,121 | 1/1965 | Alexander | 115/17 |
| 3,434,447 | 3/1969 | Christensen et al. | 440/89 |
| 4,392,779 | 7/1983 | Bloemers | 415/141 |

FOREIGN PATENT DOCUMENTS

| | | | |
|---|---|---|---|
| 30691 | 2/1982 | Japan | 440/88 |
| 16984 | 1/1983 | Japan | 440/66 |

*Primary Examiner*—Galen L. Barefoot
*Assistant Examiner*—Stephen P. Avila
*Attorney, Agent, or Firm*—O. T. Sessions

[57] ABSTRACT

Water inlets (16) are formed on the sides of the gearcase (13) of a marine propulsion unit. Ramps (26) and (27) are formed in the gearcase (13) ahead of the inlets (16) to direct flow to the inlets (16). The ramp (26) ahead of the upper ports (16) has a greater depth to provide a substantial flow of water at positive pressure, while the ramp (27) ahead of the lower ports (16) has a lesser depth to avoid disturbances in flow when the unit is operated at high speeds where the upper inlets (16) are normally above the resting surface of the water.

6 Claims, 5 Drawing Figures

WATER INLET FOR OUTBOARD PROPULSION UNIT

TECHNICAL FIELD

This invention relates to outboard propulsion units and particularly to the water inlet ports for supplying cooling water to the driving engine.

BACKGROUND ART

Outboard propulsion units generally use a water pump located in the strut of the propulsion unit, above the gearcase which supports the propeller and propeller shaft, to supply cooling water to the engine. The water inlet for supplying water to the water pump and thence to the engine is commonly located in the strut below the pump, as shown in U.S. Pat. No. 4,392,779 to Bloemers, et al. The inlets generally consist of a plurality of identical ports through the side of the strut leading to a passage connected to the inlet of the water pump. A number of other inlets have been proposed for high speed propulsion units, such as those illustrated in U.S. Pat. No. 2,616,386 to Kiekhaefer, U.S. Pat. No. 2,847,967 to Kiekhaefer, and U.S. Pat. No. 3,164,121 to Alexander.

DISCLOSURE OF INVENTION

An object of the invention is to provide a cooling water inlet which is effective in both low and high speed installations. Another object of the invention is to provide water at a positive pressure to the inlet of the pump. Yet another object of the invention is to provide such an inlet which produces little disturbance of the external water flow aft of the inlet.

The present invention provides a cooling water circulation system for an outboard propulsion unit, such as an outboard motor or stern drive, having a lower portion which includes a generally vertical streamlined strut and a torpedo at the lower end of the strut for supporting a generally horizontal shaft which carries a propeller aft of the torpedo. The cooling water circulation system includes a plurality of inlet ports at different heights in the side wall of the strut for supplying water to the water circulation system. Each port has a rear wall area exposed directly to the external flow stream for directing flow into the ports. The frontal flow directing area of the exposed rear wall of the uppermost of the ports is greater than the corresponding area of the lowest of the ports.

Preferably, the outboard propulsion unit includes a ramp means formed in the side wall of the strut forward of the inlet ports for exposing the rear walls of said ports and directing flow into the ports. The ramp means can consist of a plurality of ramps leading to the ports, with the upper of the ramps having a greater depth than the lower ramps.

The invention is particularly suitable for use where the inlet ports are positioned forward of a line denoting the maximum thickness of the strut so the inlets are positioned in a relatively high pressure region on the strut.

BEST MODE FOR CARRYING OUT THE INVENTION

Figure 2:
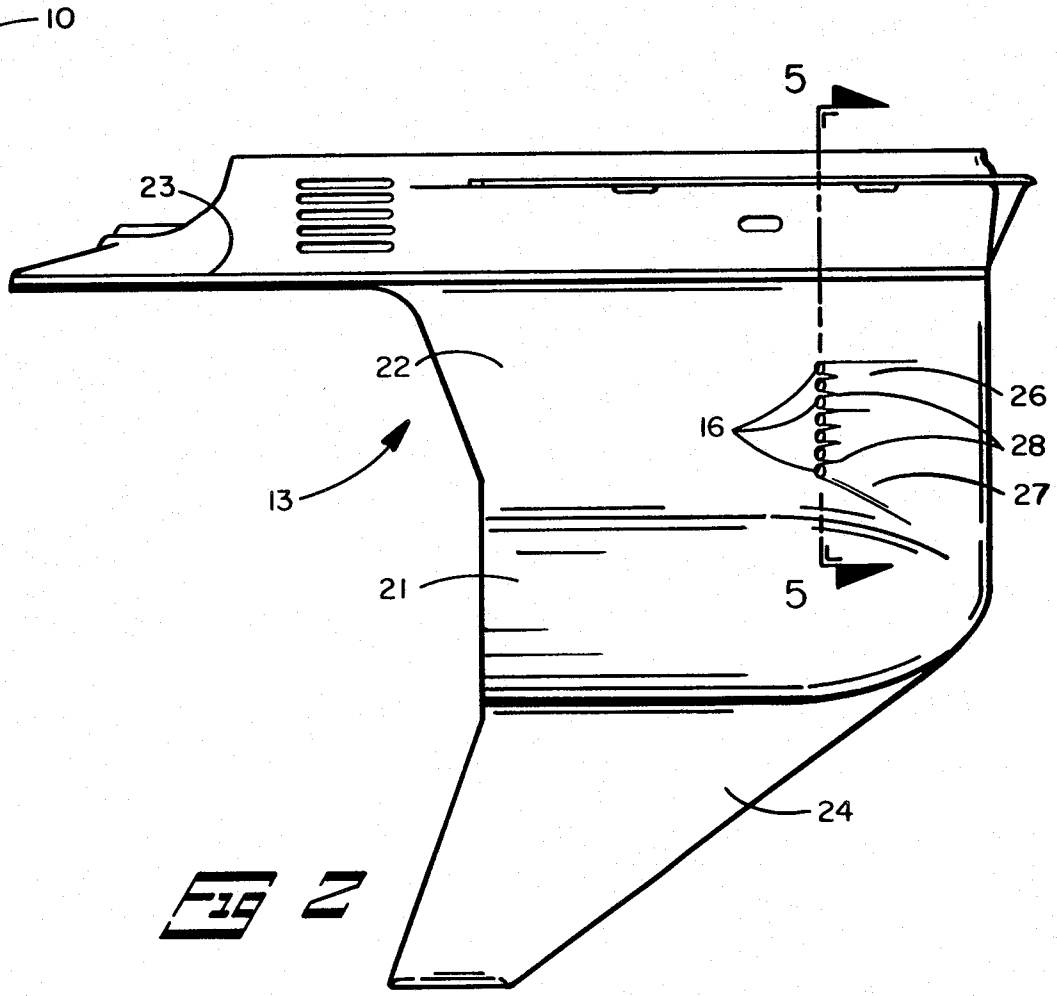
FIG. 2 is an enlarged side view of the lower portion of the outboard motor showing details of the water inlet.
Figure 1:
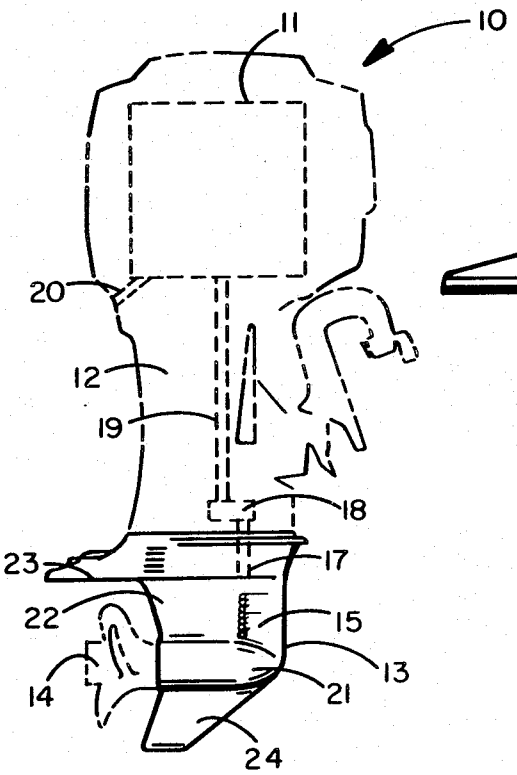
FIG. 1 is a side view of an outboard motor incorporating the water inlets of the invention.
Figure 3:
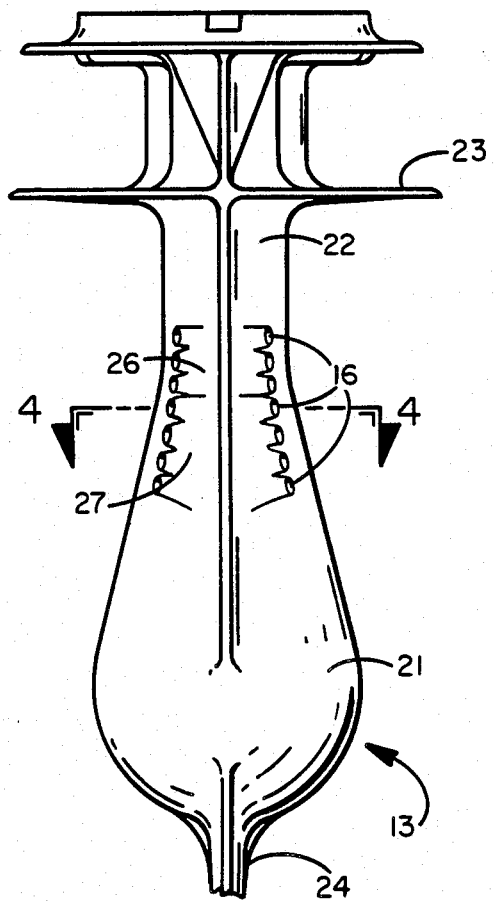
FIG. 3 is a front view of the lower unit shown in FIG. 2.
Figure 5:
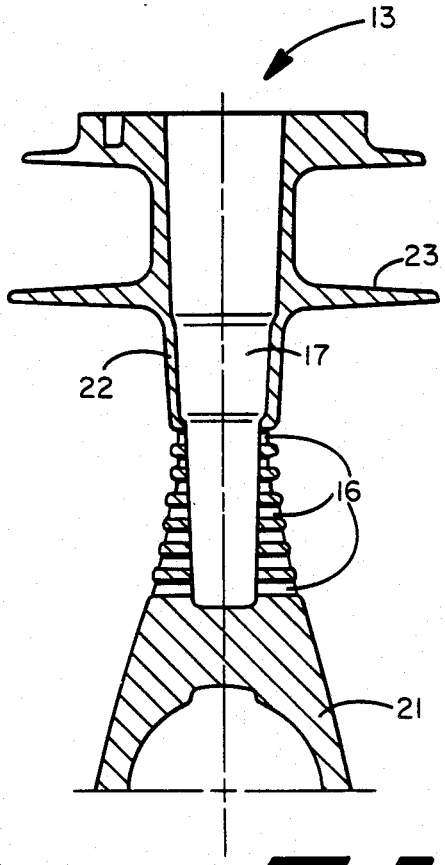
FIG. 5 is a partial section view taken along the line 5—5 of FIG. 2.
Figure 4:
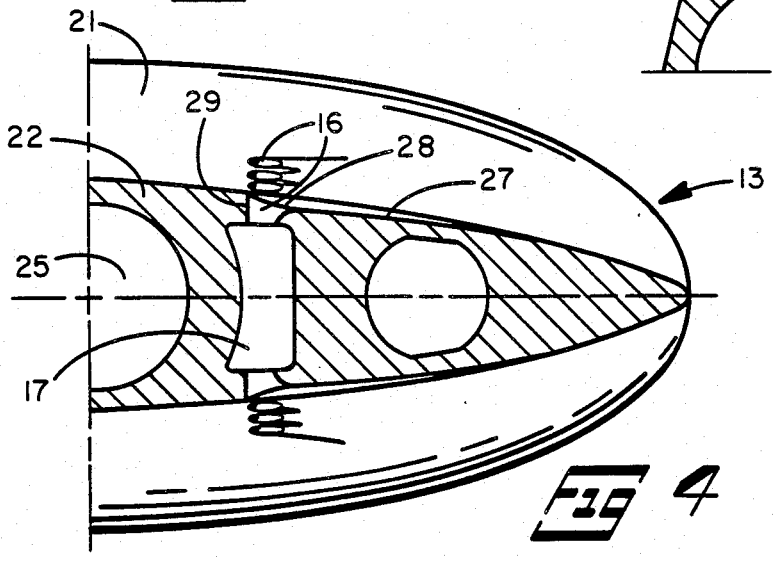
FIG. 4 is a partial sectional view taken along the line 4—4 of FIG. 3.

Turning to the drawings, the invention is illustrated as applied to an outboard motor 10 having an internal combustion engine 11 supported at the upper end of a drive shaft housing 12. A gearcase 13 is attached to the lower end of the drive shaft housing 12 and carried a propeller 14 on a propeller shaft connected by a generally vertical drive shaft, not illustrated, to be driven by the engine 11.

Water inlets 15 consisting of a plurality of inlet ports 16 on opposite sides of the gearcase 13 are connected by an inlet passage 17 to a water pump 18 in the drive shaft housing 12. An outlet passage 19 from the pump 18 supplies water to cool the engine 11. Following passage through the engine 11, the water is discharged overboard through a passage 20.

For most low and intermediate speed applications, the outboard motor 10 will be mounted on the transom of a boat at a height which will keep the propeller 14 and water inlets 15 completely submerged during motor operation. For higher speed installations, however, it is normal to mount the outboard motor 10 on the boat at an elevated position so that during high speed operation the propeller 14 will be only partially submerged in the water. Thus during high speed operation, the upper water inlet ports will normally be above the surface of the water.

The gearcase 13 includes a generally hollow torpedo 21 for housing a propeller shaft and transmission gears, not illustrated. A streamlined strut portion 22 is formed above the torpedo 21 to connect the gearcase 13 to the drive shaft housing 12. A planar anti-ventilation plate 23 is formed near the top of the strut 22 to prevent the propeller 14 from drawing air from the water surface. Below the torpedo 21 a skeg 24 is formed in a conventional manner. A vertical passage 25 extends upward from the torpedo 21 at the thickest portion of the strut 22 to accommodate the drive shaft, not illustrated. A water inlet passage 17, formed in the strut forward of the drive shaft passage 25, supplies water to the inlet of the water pump 18.

The water inlet ports 16 are formed through each side of the strut 22 ahead of the drive shaft passage 25 to connect the water passage 17 to the external body of water. Ramps 26 and 27 are formed in the strut 22 forward of the water inlets 15 to direct water to the inlet port 16. The leading edges of the ports 16 are rounded to blend into the ramps 26 and 27. Triangular fairings 28 extend forward between the ports 16 to further guide the flow. The ramps 26 and 27 thus direct a generally streamlined flow of water to the inlet ports 16 with the exposed rear walls 29 of the ports 16 directing water flow into the water passage 17. The ramps 26 and 27 thus provide positive pressure water flow into the water passage 17.

The ramps 26 in front of the upper three inlet ports 16 on each side of the strut 22 extend to a substantially greater depth into the strut 22 than the ramps in front of the lower inlet ports. Further, the inlet ports 16 are positioned at such a height that the lower four inlet ports will be submerged in the water during high speed operation, while the upper three inlet ports will rise above the surface of the water at high speeds. Though the upper three inlet ports will be above the surface of the water at high speeds, a sheet of water will be forced upward along the strut and keep the upper inlet ports covered with water so the pump 18 will not draw air. This construction allows the upper ports to have a sufficiently deep ramp 26 to provide a substantial flow of water at positive pressure to the inlet ports 16 when the unit is operated at low and intermediate speeds. At high speeds, the deeper upper ramps could lead to perturbations in the flow downstream of the ports 16 which would otherwise disturb the flow to the propeller. However with the present configuration installed at the proper height for high speed operation, the upper ports will be above the operating surface of the water and thus not produce significant disturbances downstream. The lower ports have their inlet ramp 27 sized to eliminate the disturbance of the flow downstream of the ports 16 at high speed while providing sufficient water flow at positive pressure. The invention thus provides a water inlet that supplies water at a positive pressure to the pump inlet and is effective for both high and low speed installations.

We claim:

1. An outboard propulsion unit having a lower portion including a generally vertical streamlined strut, a torpedo gearcase including a at the lower end of said strut for supporting a propeller aft of said gearcase, and a cooling water circulation system, said system including a plurality of inlet ports at different heights in the lateral side wall of said strut, aft of the leading edge of said strut, for supplying water to said water circulation system, each port having a rear wall area exposed directly to the external flow stream for turning flow into said ports, the flow directing area of the exposed rear wall of the uppermost of said ports being greater than the corresponding area of the lowest of said ports.

2. The outboard propulsion unit defined in claim 1 including a ramp means formed in said side wall of said strut forward of said inlet ports for exposing said rear walls of said ports and directing flow into said ports.

3. The outboard propulsion unit defined in claim 2 wherein said ramp means has a plurality of ramps leading to said ports.

4. The outboard propulsion unit defined in claim 3 wherein the upper of said ramps has a greater depth than the lower of said ramps.

5. The outboard propulsion unit defined in claim 4 wherein said inlet ports are positioned forward of a line denoting the maximum thickness of said strut.

6. The outboard propulsion unit defined in claim 5 wherein said strut has a greater thickness at its lower end than at its upper end.

* * * * *